US007731475B2

(12) United States Patent
Hardin

(10) Patent No.: US 7,731,475 B2
(45) Date of Patent: Jun. 8, 2010

(54) TILTED CONE DIFFUSER FOR USE WITH AN EXHAUST SYSTEM OF A TURBINE

(75) Inventor: James R. Hardin, North Huntingdon, PA (US)

(73) Assignee: Elliott Company, Jeannette, PA (US)

( * ) Notice: Subject to any disclaimer, the term of this patent is extended or adjusted under 35 U.S.C. 154(b) by 77 days.

(21) Appl. No.: 11/749,975

(22) Filed: May 17, 2007

(65) Prior Publication Data

US 2009/0068006 A1 Mar. 12, 2009

(51) Int. Cl.
*F01D 25/30* (2006.01)

(52) U.S. Cl. ..... 415/1; 415/207; 415/224.5; 415/225

(58) Field of Classification Search ..... 415/1, 415/207, 208.1, 213.1, 220, 224.5, 225
See application file for complete search history.

(56) References Cited

U.S. PATENT DOCUMENTS

| | | | | |
|---|---|---|---|---|
| 3,447,741 | A | 6/1969 | Havette et al. | |
| 3,631,674 | A | 1/1972 | Taylor | |
| 3,802,187 | A | 4/1974 | Titus | |
| 3,832,089 | A | 8/1974 | Moellmann | |
| 3,997,281 | A | 12/1976 | Atkinson | |
| 4,181,467 | A | 1/1980 | Campbell | |
| 4,214,452 | A * | 7/1980 | Riollet et al. | 415/914 |
| 4,391,566 | A | 7/1983 | Takamura | |
| 5,011,371 | A | 4/1991 | Gottemoller | |
| 5,077,967 | A | 1/1992 | Widener et al. | |
| 5,102,298 | A | 4/1992 | Kreitmeier | |
| 5,165,452 | A | 11/1992 | Cheng | |
| 5,174,120 | A * | 12/1992 | Silvestri, Jr. | 60/692 |
| 5,188,510 | A | 2/1993 | Norris et al. | |
| 5,257,906 | A | 11/1993 | Gray et al. | |
| 5,494,405 | A | 2/1996 | Gray et al. | |
| 5,518,366 | A | 5/1996 | Gray | |
| 5,603,604 | A | 2/1997 | Norris et al. | |
| 6,261,055 | B1 | 7/2001 | Owczarek | |
| 6,406,252 | B2 | 6/2002 | Kuhn | |
| 6,419,448 | B1 | 7/2002 | Owczarek | |
| 6,444,033 | B1 | 9/2002 | O'Mara et al. | |
| 6,488,470 | B1 | 12/2002 | Owczarek | |
| 6,578,607 | B2 | 6/2003 | O'Mara et al. | |
| 6,638,043 | B1 | 10/2003 | Khalifa | |
| 6,695,579 | B2 | 2/2004 | Meng | |
| 6,698,205 | B2 | 3/2004 | Tarelin et al. | |
| 6,733,238 | B2 | 5/2004 | Hiyama et al. | |
| 6,866,479 | B2 | 3/2005 | Ishizaka et al. | |
| 6,896,475 | B2 | 5/2005 | Graziosi et al. | |
| 6,917,521 | B2 | 7/2005 | Tomioka et al. | |

(Continued)

*Primary Examiner*—Igor Kershteyn
(74) *Attorney, Agent, or Firm*—The Webb Law Firm

(57) ABSTRACT

An exhaust system for a turbine includes an annular diffuser and a collector. The annular diffuser is positioned adjacent to a final stage of the turbine and includes a hub portion surrounding a turbine shaft and an outer cone having a substantially frusto-conical shape that is radially symmetrical about a central longitudinal axis thereof that is tilted relative to the turbine shaft. The collector has an inlet extending from the annular diffuser and an outlet. The collector is configured to include a turn that causes the collector to turn exhaust gases approximately 90° from the longitudinal axis of the turbine shaft. The outer cone of the annular diffuser is tilted in a direction of the turn of the collector.

18 Claims, 4 Drawing Sheets

U.S. PATENT DOCUMENTS

2002/0159886 A1 10/2002 Hiyama et al.
2002/0164249 A1 11/2002 Strange, Jr. et al.
2002/0174655 A1 11/2002 Tarelin et al.
2004/0228726 A1 11/2004 Ishizaka et al.

* cited by examiner

TILTED CONE DIFFUSER FOR USE WITH AN EXHAUST SYSTEM OF A TURBINE

BACKGROUND OF THE INVENTION

1. Field of the Invention

The present invention generally relates to turbines and, more particularly, annular diffusers for the exhaust from such turbines.

2. Description of Related Art

With reference to FIG. 1, exhaust systems 1 of steam turbines and industrial gas turbines typically include an annular diffuser 3 and a collector 5. Annular diffuser 3 is arranged immediately downstream of the last turbine stage followed by a dump into collector 5. Collector 5 turns the exhaust gas 90 degree from a longitudinal axis of a shaft of the turbine. Such exhaust systems 1 are used to guide the flow from an exit plane of the turbine to a downstream component such as a condenser (not shown).

However, as illustrated in FIG. 1, the 90-degree in the collector distorts the flow field in the diffuser by causing mass flow to move toward the bottom and having much more diffusion near the top than on the bottom, thereby harming diffuser performance. Most attempts to mitigate this effect involve complex, expensive geometry that increases the axial length of the exhaust system.

For instance, U.S. Pat. No. 6,866,479 to Ishizaka et al. discloses an exhaust diffuser for use with an axial-flow turbine. The exhaust diffuser comprises a hub-side tube in a cylindrical shape located concentrically with a tip-side tube to form an annular flow passageway therebetween. The exhaust diffuser further includes front struts and rear struts placed axially at an interval in the exhaust diffuser. Additionally, U.S. Pat. No. 6,261,055 to Owczarek discloses an annular diffuser having its inlet located at the exit of the last turbine blade row. The diffuser is defined by an outer flow guide and an outer surface of a bearing cone. The outer flow guide extends from a casing of the turbine for 360 degrees circumferentially about a longitudinal axis of the turbine shaft. The bearing cone surrounds the turbine shaft. The diffuser provided by the combination of the outer flow guide and the outer surface of the bearing cone is in the form of an asymmetrical diffuser. However, each of the systems proposed by these patents result in complex, expensive geometries.

Accordingly, a need exists for an exhaust system for a turbine that provides improved pressure recovery while also providing little increase in complexity and manufacturing costs.

SUMMARY OF THE INVENTION

The present invention is directed to an exhaust system for a turbine. The exhaust system includes an annular diffuser and a collector. The annular diffuser is positioned adjacent to a final stage of the turbine, and includes a hub portion surrounding a turbine shaft and an outer cone having a substantially frusto-conical shape that is radially symmetrical about a central longitudinal axis that is tilted relative to the turbine shaft. The collector has an inlet extending from the annular diffuser and an outlet. The collector is configured to include a turn that causes the collector to turn exhaust gases approximately 90° from the longitudinal axis of the turbine shaft. The outer cone of the annular diffuser is tilted in a direction of the turn of the collector.

The outer cone of the diffuser may be tilted downward at an angle of about 3° to about 7° relative to the longitudinal axis of the shaft of the turbine. Desirably, the outer cone of the diffuser may tilt at an angle of about 5° relative to the longitudinal axis of the shaft of the turbine.

The outlet of the collector may be coupled to an exhaust duct and the exhaust duct, in turn, may be coupled to a condenser.

The present invention is also directed to a turbine. The turbine includes a shaft having a central longitudinal axis, a plurality of disks attached to the turbine shaft at spaced intervals, a plurality of turbine blade rows fastened to the plurality of disks and an exhaust system. The exhaust system includes an annular diffuser and a collector. The annular diffuser includes a hub portion surrounding the turbine shaft and an outer cone having a substantially frusto-conical shape that is radially symmetrical about a central longitudinal axis that is tilted relative to the turbine shaft. The collector has an inlet extending from the annular diffuser and an outlet. The collector is configured to include a turn that causes the collector to turn exhaust gases approximately 90° from the longitudinal axis of the turbine shaft. The outer cone of the annular diffuser is tilted in a direction of the turn of the collector.

The outer cone of the diffuser may be tilted downward at an angle of about 3° to about 7° relative to the longitudinal axis of the shaft of the turbine. Desirably, the outer cone of the diffuser may tilt at an angle of about 5° relative to the longitudinal axis of the shaft of the turbine.

The outlet of the collector may be coupled to an exhaust duct and the exhaust duct, in turn, may be coupled to a condenser.

The present invention is further directed to a method of exhausting gases from a turbine. The first step of the method is to position an annular diffuser adjacent to a final stage of the turbine. The diffuser includes a hub portion surrounding a turbine shaft and an outer cone having a substantially frusto-conical shape that is radially symmetrical about a central longitudinal axis that is tilted relative to the turbine shaft. Next, a collector is positioned adjacent to the annular diffuser with an inlet extending from the annular diffuser and an outlet. The collector is configured to include a turn that causes the collector to turn exhaust gases about 90° from the longitudinal axis of the turbine shaft. Finally, the outer cone of the annular diffuser is tilted in a direction of the turn of the collector.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE PRESENT INVENTION

Figure 1:
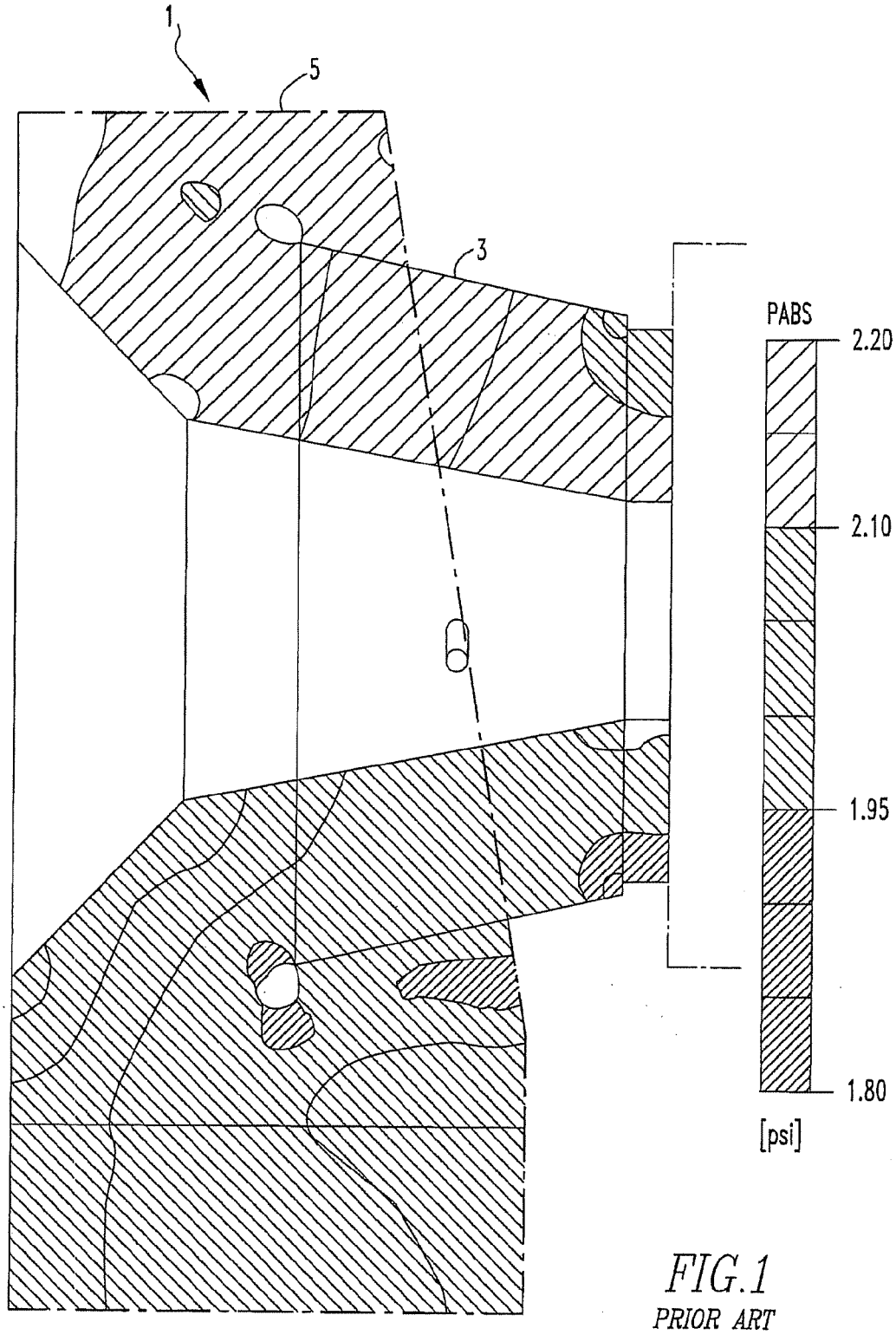
FIG.1 PRIOR ART
FIG. 1 is a schematic view of the conventional, prior art exhaust system for a turbine.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 2:
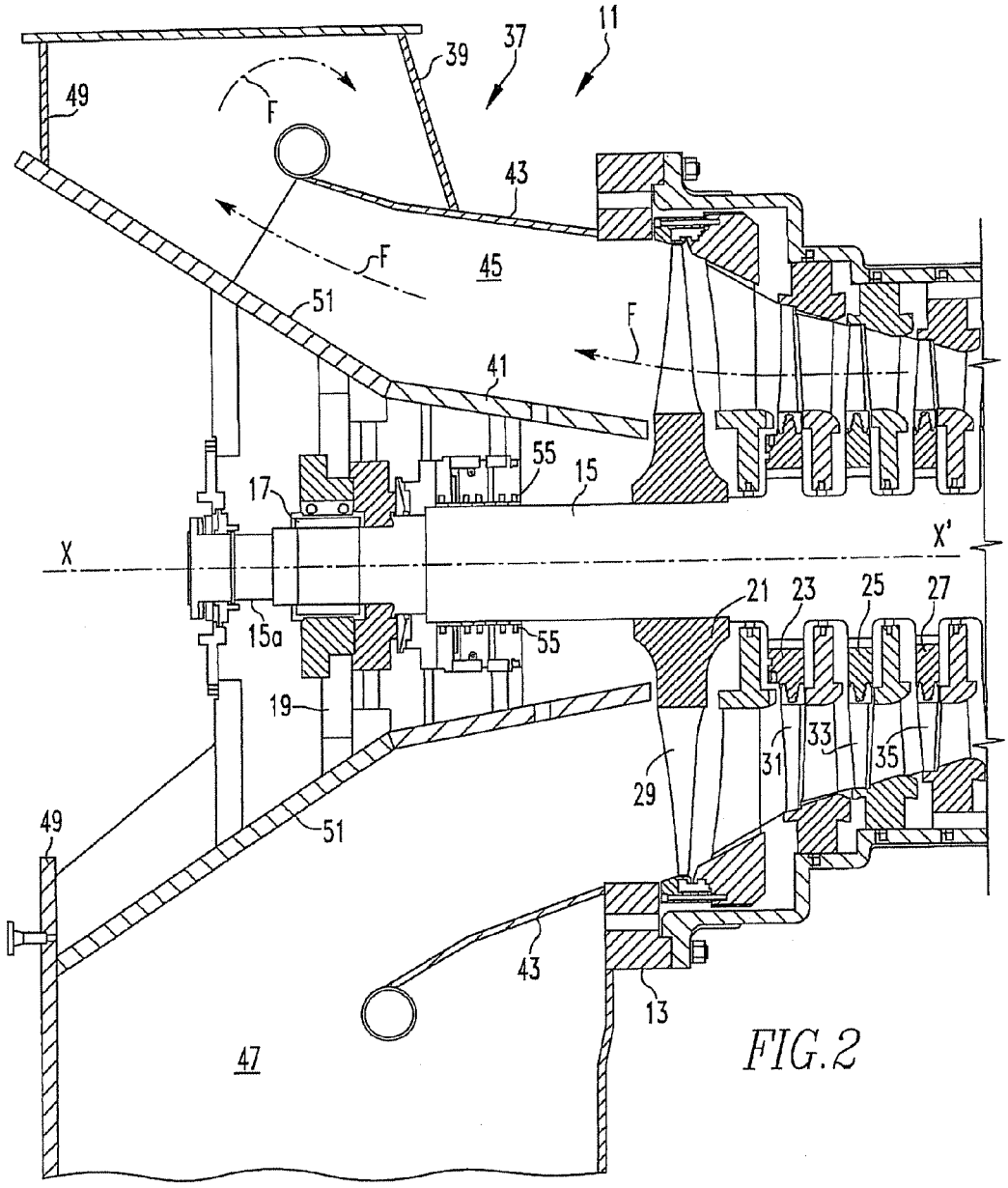
FIG. 2 is a schematic view of an exhaust system for a turbine in accordance with the present invention.
Figure 3:
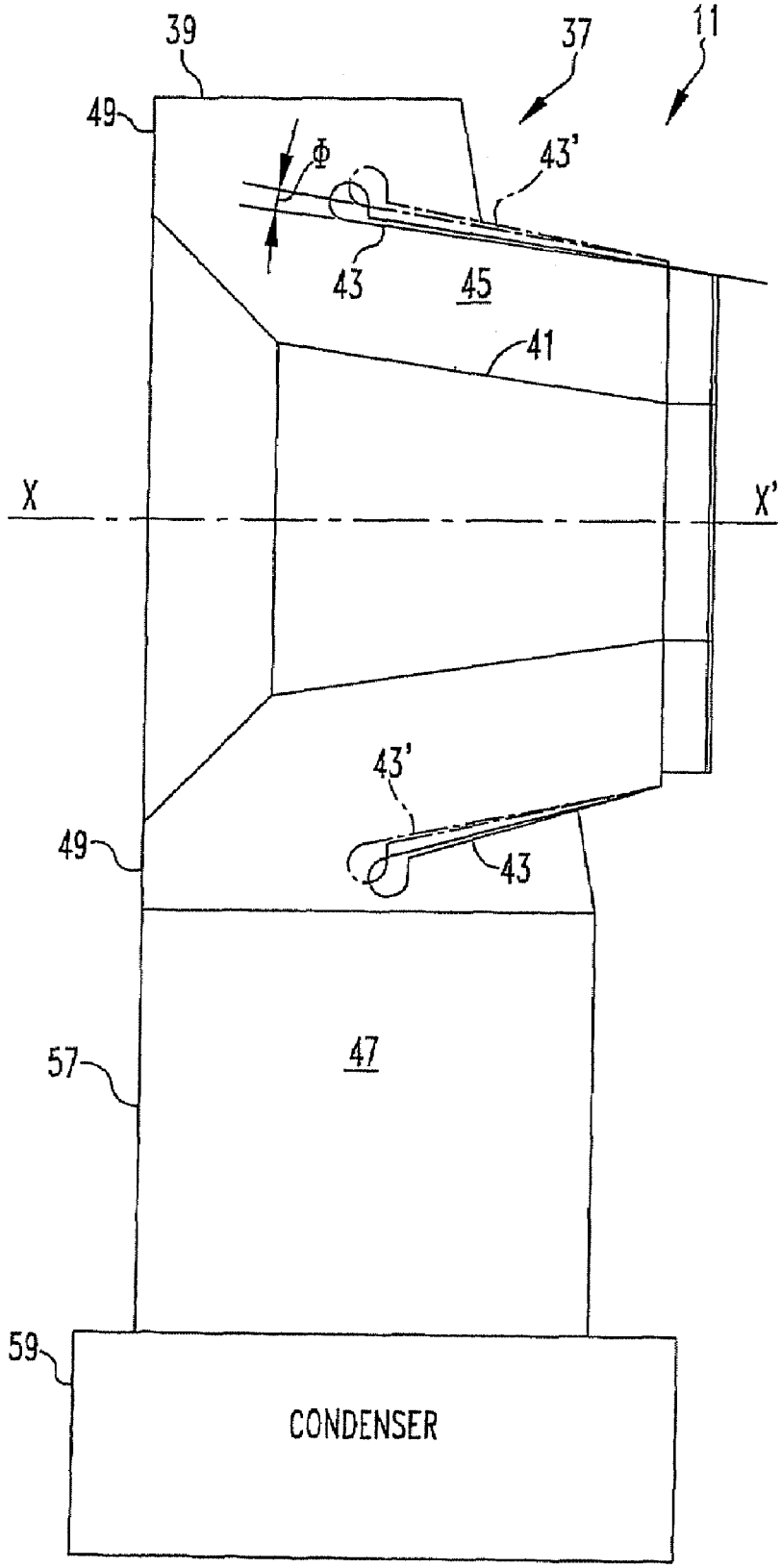
FIG. 3 is a simplified schematic view of an exhaust system for a turbine illustrating a tilted cone in accordance with the present invention.

With reference to FIGS. 2 and 3, an exhaust end of a multistage, axial-flow, condensing steam turbine, generally indicated as reference numeral 11, is illustrated. Turbine 11 includes a casing 13 partly shown. The casing 13 surrounds a shaft 15 having a central longitudinal axis X-X'. An outer portion 15*a* of shaft 15 is mounted in a bearing 17 resting on bearing pedestal 19. Attached to turbine shaft 15, at spaced intervals, are turbine disks 21, 23, 25 and 27 and fastened to each such disk is turbine blade row 29, 31, 33 and 35, respectively.

Turbine 11 also includes an exhaust system 37. Exhaust system 37 includes an annular diffuser and a collector 39. The annular diffuser includes a hub portion 41 and an outer cone 43. The annular diffuser also includes an outer cone 43 having a substantially frusto-conical shape that is radially symmetrical about its own central longitudinal axis that is tilted relative to turbine shaft 15. Outer cone 43 extends from casing 13 of turbine 11 to which it is fastened, for 360 degrees circumferentially about shaft 15 and longitudinal axis X-X'.

Hub portion 41 has the shape of a truncated cone and surrounds outer portion 15*a* of turbine shaft 15 and bearing 17. Hub portion 41 has an outside surface 51 facing outer cone 43 and an inside surface facing bearing 17 and shaft 15. A shaft seal 55 is mounted centrally of hub portion 41. The purpose of shaft seal 55 is to prevent flow of air into exhaust system 37 along turbine shaft 15.

Collector 39 has an inlet 45 extending from annular diffuser and an outlet 47. Collector 39 is configured to include a turn 49 that causes collector 39 to turn exhaust gases approximately 90° from longitudinal axis X-X' of turbine shaft 15. Outlet 47 of collector 39 is coupled to an exhaust duct 57, which is coupled to a device such as condenser 59.

Steam flows in turbine 11 from right to left as indicated by arrows F in FIG. 2, through turbine casing 13, turbine blade rows 29, 31, 33 and 35 to exhaust system 37 and then downward to condenser 59. Immediately following turbine blade row 35 is the annular diffuser, which is defined by hub portion 41 and outer cone 43.

With reference to FIG. 3, and with continuing reference to FIG. 2, outer cone 43 of the annular diffuser is tilted downward in a direction of turn 49 of collector 39 by an angle of Φ from the conventional position of outer cone 43' (shown in phantom) and relative to longitudinal axis X-X' of turbine shaft 15. Outer cone 43 of the diffuser may be tilted downward at an angle Φ of about 3° to about 7° and, desirably, about 5°. By tilting the angle at such an angle, similar mass flow per unit area, as measured in kg $m^{-2}$ $s^{-1}$, at the top and bottom of the exit of the outer cone is achieved. Accordingly, exhaust system 37 of the present invention achieves substantial improvements in pressure recovery with no increase in axial length and very little increase in complexity.

EXAMPLES

The following examples provide compare the present invention to prior art devices. The examples are intended to be illustrative only and are not intended to limit the scope of the invention.

Outer cone 43 is tilted at an angle such that similar mass flow per unit area exists around the circumference of outer cone 43. As discussed above, outer cone 43 of the diffuser may be tilted downward at an angle Φ of about 3° to about 7° and, desirably, about 5°. By tilting outer cone 43 at the desired angle, the circumferential distribution of pressure recovery in the diffuser is caused to be more uniform, thereby dramatically improving overall pressure recovery.

Figure 4:
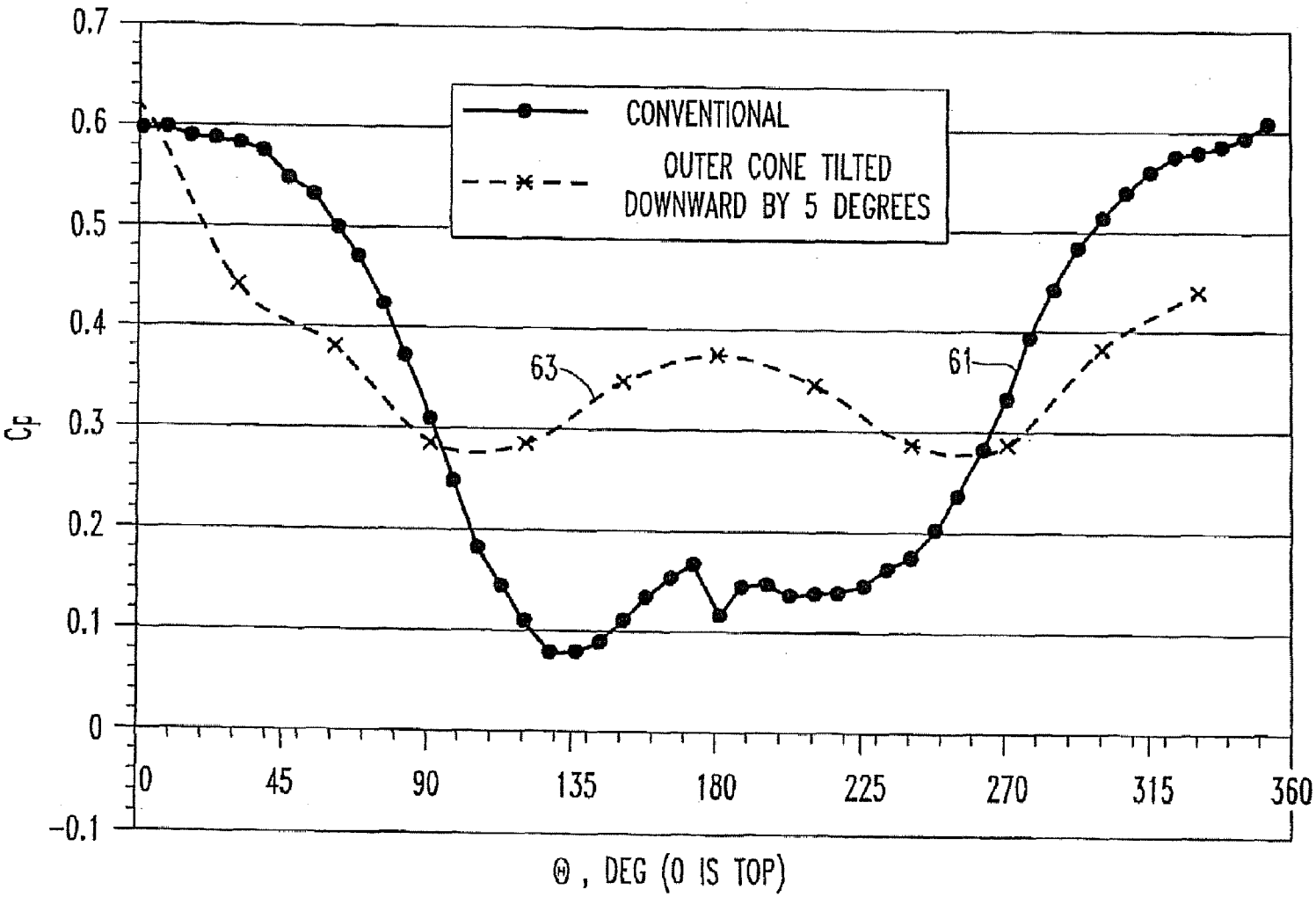
FIG. 4 is a graph illustrating circumferential distribution of pressure recovery versus a location around the circumference of an outer cone of the diffuser.

For example, the graph of FIG. 4 illustrates a graph of the circumferential distribution of pressure recovery versus an angular location (θ) around the circumference of an outer cone 43 of the diffuser. Line 61 illustrates the circumferential distribution of pressure recovery in a conventional exhaust system while line 63 illustrates the circumferential distribution of pressure recovery in exhaust system 37 with outer cone 43 tilted at a downward angle Φ of about 5°. As can be seen by comparing line 61 with line 63, the circumferential distribution of pressure recovery is much more uniform for exhaust system 37 than the conventional exhaust system.

Furthermore, the angled and improved flow field, caused by the tilted outer cone 43, entering collector 39 reduces loss in collector 39 thereby further improving overall exhaust pressure recovery. For instance, a pressure recovery of 1.0 is the maximum theoretically possible. A conventional exhaust system achieving a pressure recovery of 0.5 is considered very good. Additionally, most exhaust systems with an axial length as short as the axial length of exhaust system 37 of the present invention have a pressure recovery that is less than 0.0 thereby creating a pressure loss.

An exhaust system with an untilted, conventional outer cone structure has a pressure recovery of about 0.0. When outer cone 43 is tilted at a downward angle Φ of about 5°, the pressure recovery is increased from about 0.0 to about 0.2.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. For example, it is to be understood that the present invention contemplates that, to the extent possible, one or more features of any embodiment can be combined with one or more features of any other embodiment.

The invention claimed is:

1. An exhaust system for a turbine comprising:

a) an annular diffuser positioned adjacent to a final stage of the turbine, the diffuser comprising:

i) a hub portion surrounding a turbine shaft, the turbine shaft having a central longitudinal axis; and ii) an outer cone having a substantially frusto-conical shape that is radially symmetrical about a central longitudinal axis thereof that is tilted relative to the turbine shaft; and b) a collector having an inlet extending from the annular diffuser and an outlet, the collector configured to include a turn that causes the collector to turn exhaust gases 90° from the longitudinal axis of the turbine shaft, wherein the outer cone of the annular diffuser is tilted in a direction of the turn of the collector.

2. The exhaust system of claim 1, wherein the outer cone of the diffuser tilts downward.

3. The exhaust system of claim 2, wherein the outer cone of the diffuser tilts at an angle of about 3° to about 7° relative to the longitudinal axis of the shaft of the turbine.

4. The exhaust system of claim 3, wherein the outer cone of the diffuser tilts at an angle of about 5° relative to the longitudinal axis of the shaft of the turbine.

5. The exhaust system of claim 1, wherein the outlet of the collector is coupled to an exhaust duct.

6. The exhaust system of claim 5, wherein the exhaust duct is coupled to a condenser.

7. A turbine comprising:

a turbine shaft having a central longitudinal axis;

a plurality of disks attached to the turbine shaft at spaced intervals;

a plurality of turbine blade rows fastened to the plurality of disks; and an exhaust system comprising:

an annular diffuser comprising:

a hub portion surrounding the turbine shaft; and an outer cone having a substantially frusto-conical shape that is radially symmetrical about a central longitudinal axis thereof that is tilted relative to the turbine shaft; and a collector having an inlet extending from the annular diffuser and an outlet, the collector configured to include a turn that causes the collector to turn exhaust gases 90° from the longitudinal axis of the turbine shaft, wherein the outer cone of the annular diffuser is tilted in a direction of the turn of the collector.

8. The turbine of claim 7, wherein the outer cone of the diffuser tilts downward.

9. The turbine of claim 8, wherein the outer cone of the diffuser tilts at an angle of about 3° to about 7° relative to the longitudinal axis of the shaft of the turbine.

10. The turbine of claim 9, wherein the outer cone of the diffuser tilts at an angle of about 5° relative to the longitudinal axis of the shaft of the turbine.

11. The turbine of claim 7, wherein the outlet of the collector is coupled to an exhaust duct.

12. The turbine of claim 11, wherein the exhaust duct is coupled to a condenser.

13. A method of exhausting gases from a turbine comprising the steps of:

positioning an annular diffuser adjacent to a final stage of the turbine, the diffuser comprising:

a hub portion surrounding a turbine shaft, the turbine shaft having a central longitudinal axis; and an outer cone having a substantially frusto-conical shape that is radially symmetrical about a central longitudinal axis thereof that is tilted relative to the turbine shaft;

positioning a collector adjacent to the annular diffuser with an inlet extending from the annular diffuser and an outlet, the collector configured to include a turn that causes the collector to turn exhaust gases about 90° from the longitudinal axis of the turbine shaft; and tilting the outer cone of the annular diffuser in a direction of the turn of the collector.

14. The method of claim 13, wherein the outer cone of the diffuser tilts downward.

15. The method of claim 14, wherein the outer cone of the diffuser tilts at an angle of about 3° to about 7° relative to the longitudinal axis of the shaft of the turbine.

16. The method of claim 15, wherein the outer cone of the diffuser tilts at an angle of about 5° relative to the longitudinal axis of the shaft of the turbine.

17. The method of claim 13, wherein the outlet of the collector is coupled to an exhaust duct.

18. The method of claim 17, wherein the exhaust duct is coupled to a condenser.

* * * * *